United States Patent [19]

Moeller

[11] 4,044,728

[45] Aug. 30, 1977

[54] INTERNAL COMBUSTION ENGINE

[76] Inventor: Guido Moeller, Box 3647, Washington, D.C. 20007

[21] Appl. No.: 624,835

[22] Filed: Oct. 22, 1975

[51] Int. Cl.[2] ..... F02F 1/10; F01B 19/00

[52] U.S. Cl. ..... 123/18 A; 92/99; 92/101; 123/191 R; 123/191 A; 123/193 R; 123/193 P

[58] Field of Search ..... 123/18, 191 R, 191 A, 123/193 R, 193 P; 92/99, 101; 417/472, 478, 479

[56] References Cited

U.S. PATENT DOCUMENTS

| | | | |
|---|---|---|---|
| 1,180,947 | 4/1916 | Scott | 123/193 R |
| 1,181,802 | 5/1916 | Rogge | 123/193 R |
| 2,712,427 | 7/1955 | Welborn et al. | 92/101 |
| 3,066,698 | 12/1962 | Siri | 92/101 |
| 3,272,089 | 9/1966 | Rietdijk | 92/99 |
| 3,911,796 | 10/1975 | Hull et al. | 92/101 |

*Primary Examiner*—Carroll B. Dority, Jr.
*Assistant Examiner*—Craig R. Feinberg
*Attorney, Agent, or Firm*—Edwin E. Greigg

[57] ABSTRACT

An internal combustion engine includes a rigid wall having a curved surface which forms part of the combustion chamber. The remaining part of the combustion chamber is formed by a flexible curtain whose outer edge is attached and sealed to the rigid wall. The wall and the curtain together form a closed space whose geometry and volume depend on their relative position. When the curtain moves toward the wall, the two approaching surfaces displace gas toward the center of the combustion chamber, thereby compressing it or expelling it from the chamber.

16 Claims, 3 Drawing Figures

INTERNAL COMBUSTION ENGINE

BACKGROUND OF THE INVENTION

The invention relates to an internal combustion engine which may be internally or externally ignited and may be supplied with a combustible fuel-air mixture in any known and suitable manner, for example by carburetion or by fuel injection. The engine may be of the 4-cycle type, performing successive intake, compression, power and exhaust strokes.

In known 4-cycle engines of this type, a sliding or rotating and sliding piston compresses a fuel-air mixture in a combustion chamber. The sliding friction between the piston or piston seals and the cylinder wall is reduced by continuous lubrication requiring extensive auxiliary equipment e.g. an oil sump, an oil pump, multiple conduits, etc. In addition, the compression seal of such an engine is always imperfect, even when all parts are new, and gradually deteriorates even further due to wear. Furthermore, oil leaking into the combustion chamber produces smoke and other harmful substances which are vented to the atmosphere.

OBJECTS AND SUMMARY OF THE INVENTION

It is a principal object of the invention to provide an internal combustion engine in which any sliding friction is reduced substantially, thus obviating cylinder wall lubrication.

It is another object of the invention to provide an internal combustion engine with permanent seals which are not subject to leakage due to wear.

Yet another object is to provide an engine with few parts and of relatively inexpensive construction. These and other objects are attained, briefly stated, by providing a rigid wall, at least part of whose surface is curved. Advantageously, the curved portion of the wall surface is toroidal, i.e. portions of the wall correspond to surfaces of a torus. The wall may encompass a substantially complete torus or only a portion thereof. In particular, the toroidal surface is not limited to having one or more circular crossections. The central region of the wall may extend substantially cylindrically in the axial direction and this region is terminated by a dome or head portion which, in known manner, includes valves and, usually, a spark plug. Attached to the rim of the rigid wall is a flexible curtain which substantially conforms to the surface contour of the rigid wall but which, due to its inherent elasticity, can be pulled away from the wall, thereby forming an intervening space. During the approach of the curtain to the wall, gas is forced out of the intervening space into a central space which forms the main combustion chamber where ignition takes place and from which spent gases are exhausted. The central base of the curtain is connected to a crankshaft or other suitable motion converter means. Valve timing is performed in known manner in synchronism with the crankshaft rotation.

The invention will be better understood as well as other objects and advantages thereof become more apparent from the ensuing detailed description of two preferred embodiments, taken in conjunction with the drawing.

DESCRIPTION OF THE PREFERRED EMBODIMENTS

Figure 1:
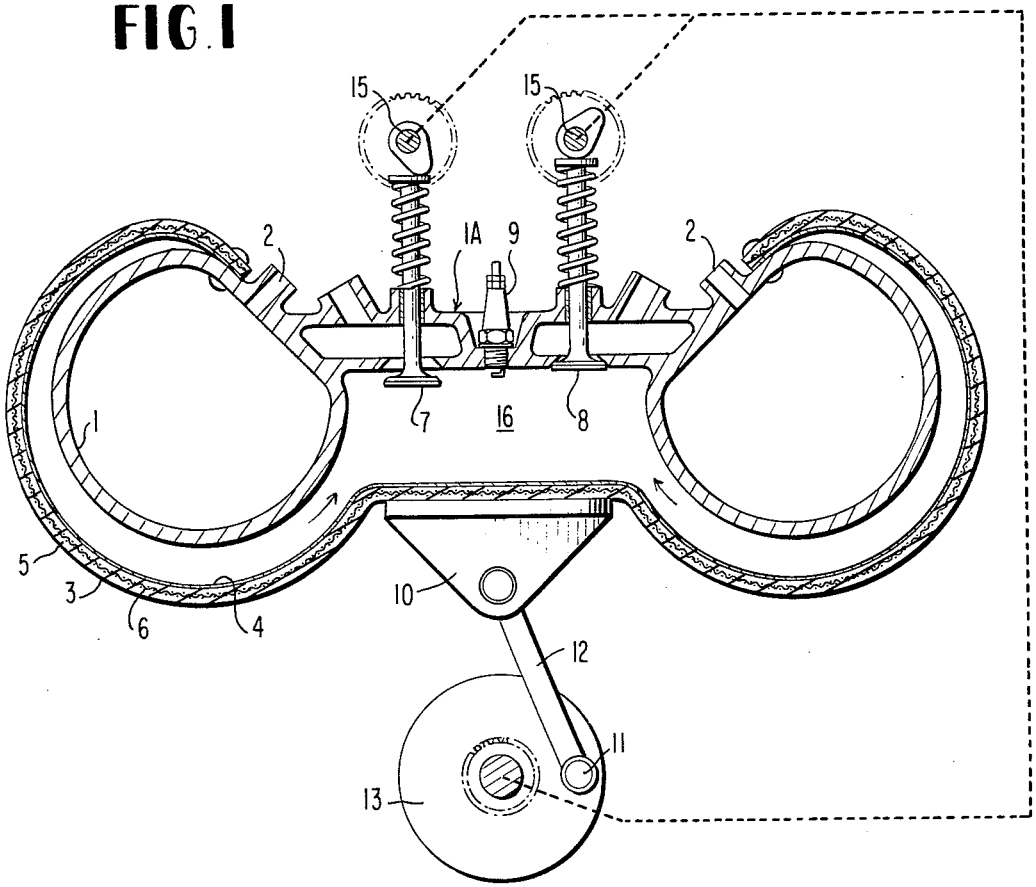
FIG. 1 is a sectional side view of the main elements of an engine according to the invention.
Figure 2A:
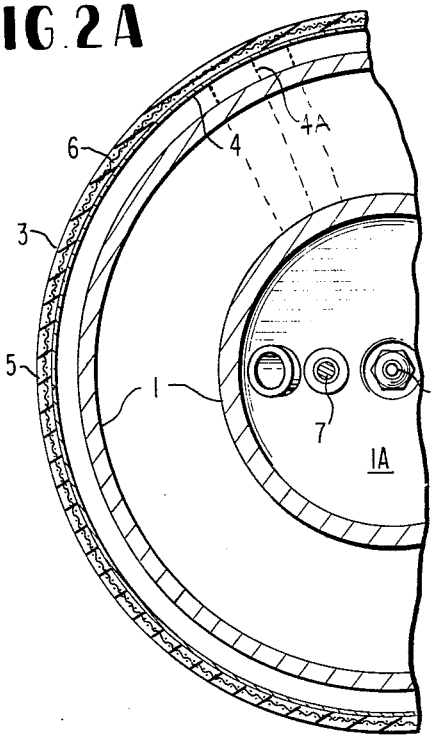
FIG. 2A is a partial top view of the engine of FIG. 1 showing a first embodiment of the curtain.

Turning now to FIG. 1, there is shown a substantially toroidal wall 1, preferably made of cast, forged or machined metal parts, the metal being, e.g., aluminum, iron, steel or some suitable alloy. The wall 1 has a central head portion 1A. The wall 1 may be a full torus, substantially as shown, i.e. closed onto itself in the manner of a doughnut, or it may be partially incomplete, in the manner of a sliced bagel. The large central radius R may be constant, as shown in FIG. 2 or it may vary, thus making the planar crossection non-circular. Similarly, the small radius $r$ may be constant over azimuth and altitude or it may vary in either parameter. The hollow interior of the wall 1 may carry coolant, admitted and returned through openings 2. Annularly attached and sealed to the outer surface of the wall 1 is a curtain 3 which is flexible and which has a natural, unstressed shape similar to that of the wall 1. This curtain may be a single, metallic sheet 4 or a single, molded shell of synthetic material, possibly reinforced with glass or metal fibers. Preferably, the curtain includes a blanket 5, made from one or more layers of a rubber-like material which can be reinforced in known manner, e.g. with steel mesh 6. Preferably, the blanket 5 is so made and attached that it is able to provide hermetic pressure sealing of the interior volume. For this reason, the metal sheet 4 may suitably consist of several, preferably overlapping sectors 4A which serve to shield the blanket 5 from heat and/or chemical reaction with combustion gases and which can transfer heat to the wall 3 during periods of contact. The head portion 1A includes, in known manner, an intake valve 7, an exhaust valve 8, a spark plug 9 and suitable intake and exhaust channels leading to, e.g. a carburetor and to a muffler, respectively (neither shown). Attached to the base portion of the curtain 3 is a suitable block 10 serving as attachment point for the camshaft lobe 11, possibly via a connecting rod 12. A crankshaft 13 may be of any suitable construction. Suitable known means 14, e.g. belts or gears, transfer rotary motion to cam-shafts 15 or the like which actuate the valves 7,8 in the proper sequence. The operation of the described engine is as follows: During a downward stroke (as seen in the Figure) of the block 10, the curtain 3 is pulled away from the wall 1, thereby increasing the space between the curtain 3 and the wall 1. The ensuing vacuum pulls in a quantity of combustible mixture through the valve 7 while the valve 8 is closed. The valve 7 then also closes. The block 10 now moves the curtain toward the wall 1 with the result that gas is forced from in between the approaching surfaces as indicated by the arrows. Thus, the vapor is compressed and is also given momentum toward the central chamber 16. The collision of radially approaching gases induces turbulence which enhances combustion. At the instant of ignition by the spark plug 9, the curtain and the wall 1 are in very close contact, thereby excluding from the space between them virtually all combustible vapor. Thus, the combustion of gases takes place entirely in the central volume 16. The closely adjacent surfaces of the wall 1 and the curtain 3 effectively prevent the combustion shock wave from propagating beyond the volume 16. When the block 10 moves downwardly, the space between the wall 1 and the curtain 3 is increased smoothly and gradually while the combustion chamber pressure drops rapidly. Thus, the resilient curtain is able to contain the instantaneous pressure without being damaged. On the return stroke, the valve 8 is opened, permitting spent gas to be exhausted through the valve 8, in known manner, through a muffler (not shown) to the atmosphere. The large cooling surface of the wall 1, which makes intimate periodic contact with the curtain 3 insures good heat transfer out of the combustion chamber.

Figure 2B:
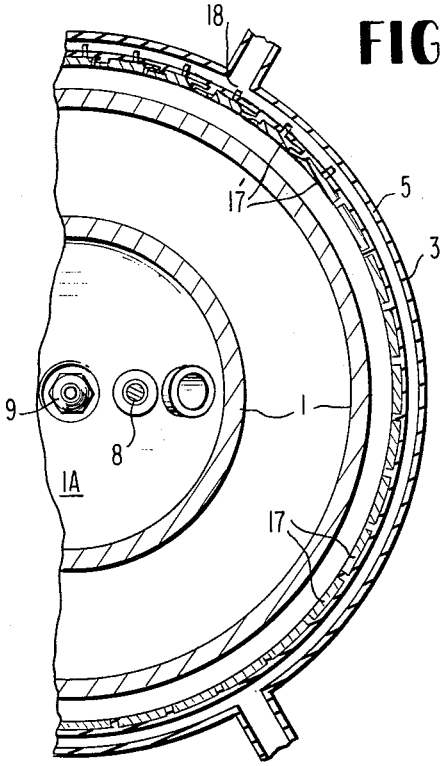
FIG. 2B is a similar view as in FIG. 2A, showing a second embodiment of the curtain.

In an alternative embodiment of the curtain, shown in FIG. 2B, the inner surface of the blanket 5 is studded with a plurality of embedded pads 17, e.g. ceramic, metal or graphite pads for the purpose of protecting the underlying blanket 5 from heat and/or chemical reaction. These pads may overlap and/or interlock to form a substantially continuous surface and their function is similar to the sheet sectors 4A in FIG. 2A. If necessary, additional coolant may be circulated through channels 18 in the blanket 5, and the pads 17 may extend into the coolant channels 18 to further enhance the heat transfer process as shown at 17'.

It is to be understood that the foregoing description of preferred embodiments is given entirely by way of an illustrative example and that numerous variants of the invention may be described without departing from the scope of the invention which is defined in the claims.

What is claimed is:

1. An internal combustion engine, comprising:

A. a rigid, curved wall;

B. a flexible curtain including a central base portion, sealingly attached along an edge region to said rigid wall and capable of substantially conforming to the surface contours of said rigid wall, thereby defining a combustion chamber of variable geometrical form and volume;

C. valve means, located in said rigid wall, for selective passage of gases to and from said combustion chamber; and D. heat transfer means for cooling said rigid wall and said flexible curtain.

2. An engine as defined in claim 1, wherein said curved wall is substantially toroidal and includes a central wall member.

3. An engine as defined in claim 2, wherein said rigid wall and said flexible curtain are continuous and metallic.

4. An engine as defined in claim 2, wherein said flexible curtain is a continuous web of synthetic material.

5. An engine as defined in claim 1, wherein said heat transfer means includes fluid channels in said rigid wall.

6. An engine as defined in claim 1, wherein said flexible curtain includes a flexible metal web covered at least by one external web of rubber-like material.

7. An engine as defined in claim 6, including a steel-mesh reinforcement web extending within said at least one web of rubber-like material.

8. An engine as defined in claim 1, further comprising:

E. eccentric rotating means, coupled to said base portion for conversion of reciprocating motion to rotary motion.

9. An engine as defined in claim 8, comprising means for selective passage of gases including an inlet valve and an outlet valve and means for cyclic actuation thereof in synchronism with the motion of said rotating means.

10. An engine as defined in claim 9, including a rigid block attached to said base portion and coupled pivotably to said eccentric rotating means.

11. An engine as defined in claim 1, wherein said flexible curtain includes a continuous flexible web of rubber-like material which is provided on the side facing said rigid wall with a plurality of pads made from a heat resistant material.

12. An engine as defined in claim 11, wherein at least some of said pads are contiguous to one another.

13. An engine as defined in claim 11, wherein at least some of said pads overlap one another.

14. An engine as defined in claim 1, wherein the surface of said rigid wall has at least one locus of inflections of curvature which lies entirely within said combustion chamber.

15. An engine as defined in claim 11, wherein portions of said pads penetrate said curtain and extend out of said combustion chamber for transfer of heat from said combustion chamber.

16. An engine as defined in claim 14, wherein said flexible curtain includes coolant channels into which said portions of said pads extend.

* * * * *